United States Patent [19]

Schaake

[11] Patent Number: 4,730,561

[45] Date of Patent: Mar. 15, 1988

[54] SUBCALIBER PROJECTILE

[75] Inventor: Henning Schaake, Cologne, Fed. Rep. of Germany

[73] Assignee: Rheinmetall GmbH, Düsseldorf, Fed. Rep. of Germany

[21] Appl. No.: 17,163

[22] PCT Filed: Apr. 10, 1986

[86] PCT No.: PCT/EP86/00210

§ 371 Date: Jan. 7, 1987

§ 102(e) Date: Jan. 7, 1987

[87] PCT Pub. No.: WO86/06828

PCT Pub. Date: Nov. 20, 1986

[30] Foreign Application Priority Data

May 11, 1985 [DE] Fed. Rep. of Germany ..... 3517125

[51] Int. Cl.[4] ..... F42B 11/00; F42B 13/16

[52] U.S. Cl. ..... 102/517; 102/521; 244/3.3

[58] Field of Search ..... 102/501, 517–523, 102/703; 244/3.24–3.3

[56] References Cited

U.S. PATENT DOCUMENTS

| | | | |
|---|---|---|---|
| 1,112,044 | 9/1914 | Watson | 102/519 |
| 1,520,131 | 12/1924 | Jacob | 244/3.3 |
| 2,983,225 | 5/1961 | Walker . | |
| 3,378,216 | 4/1968 | Ass et al. | 244/3.3 |
| 4,140,061 | 2/1979 | Campali . | |
| 4,362,107 | 12/1982 | Romer et al. | 102/520 |
| 4,553,482 | 11/1985 | Weber et al. | 102/521 X |
| 4,565,340 | 1/1986 | Bains | 244/3.3 |

FOREIGN PATENT DOCUMENTS

| | | |
|---|---|---|
| 3017380 | 11/1981 | Fed. Rep. of Germany . |
| 87354 | 6/1966 | France . |

*Primary Examiner*—Harold J. Tudor

*Attorney, Agent, or Firm*—Spencer & Frank

[57] ABSTRACT

To improve the terminal ballistic performance of a subcaliber projectile 15 composed of a penetrator **15*b* and a tail guide assembly 16, a partial region 15*a* of the projectile 15 is given a conical configuration and is seated in a likewise conically configured recess 16*a* of the guide assembly 16. Thus, the transverse forces exerted on the guide assembly 16 during penetration of the target material are prevented, at least in the conically configured region 15*a* of the guide assembly, from being transferred to the penetrator 15*b* so that the penetrator 15*b*** is prevented from breaking in this region.

11 Claims, 2 Drawing Figures

SUBCALIBER PROJECTILE

BACKGROUND OF THE INVENTION

The invention relates to a subcaliber projectile of the type which includes a penetrator and a guide assembly which coaxially surrounds the penetrator over part of its length.

Subcaliber projectiles of this type are known from British Patent No. 1,256,740. They are advisably used with cartridged ammunition and prefeably serve to combat armored targets in direct fire. Subcaliber projectiles of this type are manufactured for the most varied caliber ranges; they have already been introduced for armored cannons and automatic cannons.

For the purpose of increasing their terminal ballistic performance, the projectiles, which are also called penetrators and are frequently made of tungsten heavy metal, are made as long as possible. In this way, sufficient projectile material is available for penetration of the target. The extension of these projectiles is generally limited by the fact that the maximum cartridge length of in-service tubular weapons is limited and by the fact that that a guide assembly must be provided at the tail of the subcaliber projectile for the purpose of stabilization, which also takes up part of the space available in the cartridge case.

In order to obtain the longest possible penetrator, attempts have already been made to also make the core of the guide assembly itself of the penetrator material. If, however, the subcaliber projectile hits the target and ultimately penetrates it, the guide assembly exerts a very great transverse force on the penetrator, thus causing it to break. The broken-off part, however, generally no longer contributes to penetration of the target. Thus the terminal ballistic effect of the projectile is reduced.

SUMMARY OF THE INVENTION

It is the object of the invention to improve the terminal ballistic performance of a subcaliber projectile.

Based on a projectile of the type discussed in detail above, this is accomplished by providing a region with a conically configured surface adjacent the tail end of the penetrator, and by providing a recess with a conically configured surface in the guide assembly, the region of the penetrator with the conically configured surface being seated in the recess.

DESCRIPTION OF THE PREFERRED EMBODIMENT

Figure 1:
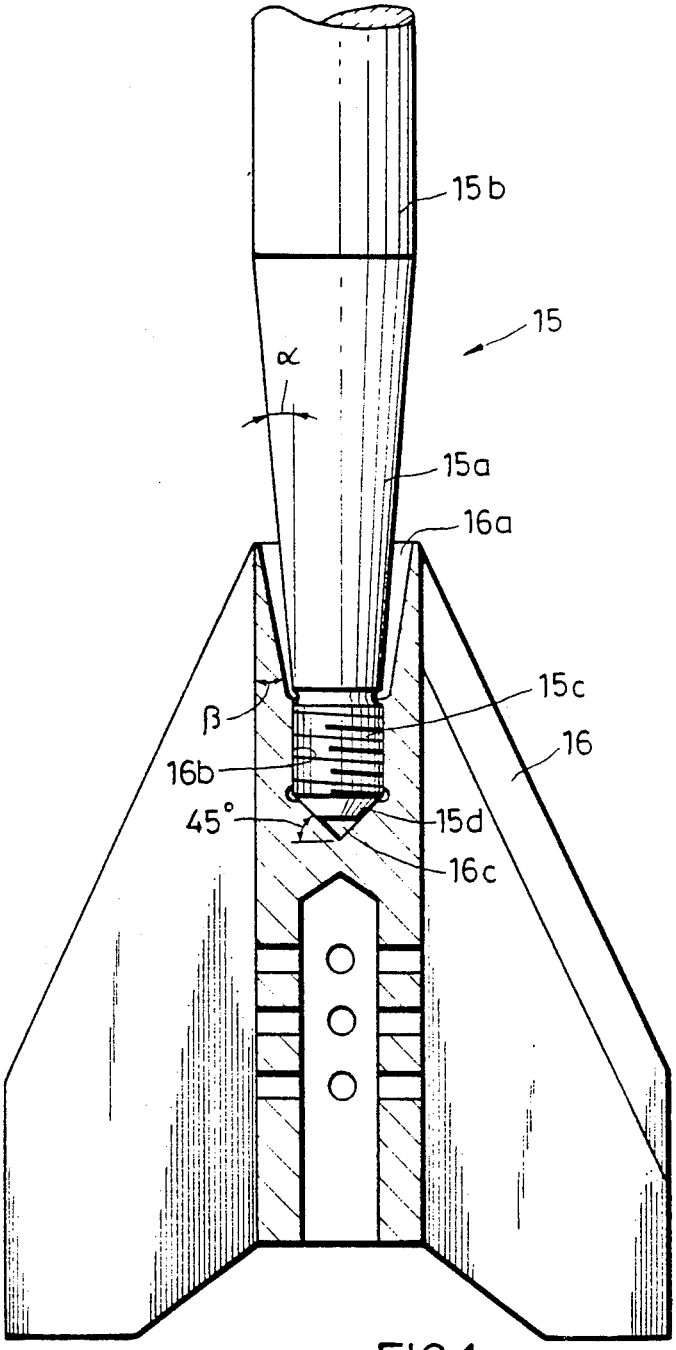
FIG. 1 is an enlarged detail view of the tail section of a subcaliber projectile.
Figure 2:
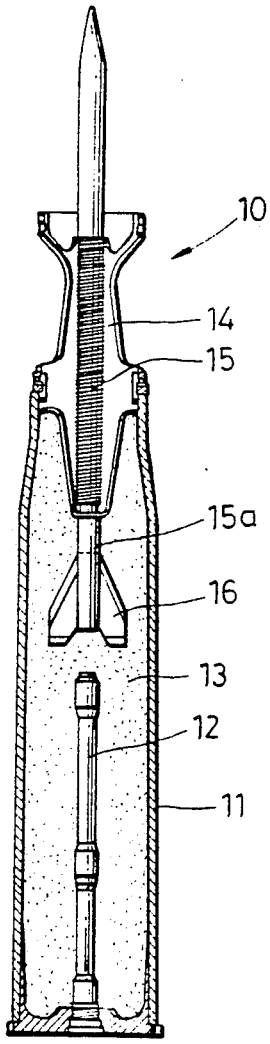
FIG. 2 is a partial sectional view of the schematic representation of cartridged ammunition and a subcaliber projectile.

FIG. 2 shows, partially in section, a schematic representation of a piece of cartridged ammunition 10 for an armored cannon. Ammunition 10 includes a cartridge case 11, in which a propelling charge igniter 12 and the propelling charge 13 are disposed. Connected with cartridge case 11 is the discarding sabot 14 which is composed of a plurality of segments and coaxially surrounds the subcaliber projectile 15 over part of its length. A fin-including guide assembly 16 is disposed at the tail of subcaliber projectile 15. After firing the cartridge, discarding sabot 14 and projectile 15 are accelerated in the gun barrel (not illustrated). After leaving the gun barrel, discarding sabot 14 is separated from projectile 15 so that the latter, stabilized by guide assembly 16, speeds toward the target. After hitting the surface of the target, projectile 15 penetrates into the target material. However, as soon as the tail guide assembly 16 comes in contact with the already partially penetrated wall of the target, a large transverse force is exerted on projectile 15 and causes projectile 15 to break, preferably in its region 15*a*, i.e. shortly before the start of tail guide assembly 16. The broken-off part of projectile 15 becomes positioned at an angle with respect to the longitudinal axis of the projectile and does not participate in the penetration of the target, thus considerably reducing the terminal ballistic performance of projectile 15. The invention now overcomes this drawback in that it makes it possible to prevent a noticeably larger region of the tail section of projectile 15 encased by guide assembly 16 from breaking off and thus enables it to participate in the penetration of the target. This then increases the terminal ballistic performance of projectile 15. The significant features of the invention will be described in connection with FIG. 1, which is an enlarged detail view of the tail section of subcaliber projectile 15. In the figure, penetrator 15*b* of projectile 15 is shown only in part. Tail section 15*a* of penetrator 15*b* has a conical configuration and is seated in a recess 16*a* of tail guide assembly 16 which is likewise provided with a conical jacket surface. Recess 16*a* has a length which is preferably between one third and two thirds of the length of section 15*a*. The slopes are here selected in such a manner that the angle $\beta$ of recess 16*a* is noticeably larger (preferably at least 2° larger) than the angle $\alpha$ of the penetrator cone. The conical region 15*a* of penetrator 15*b* is followed by a threaded cylindrical pin 15*c* which finally is delimited by a cone frustum 15*d* having a jacket surface extending at an angle of 45°. By means of pin 15*c*, penetrator 15*b* is screwed into an internally threaded recess 16*b* in guide assembly 16, with this recess 16*b* following conical recess 16*a*. Recess 16*b* opens into a blind bore 16*c* which has a conical jacket surface. The slope of the jacket surface is 45° so that, when penetrator 15*b* is screwed in, its cone 15*d* causes penetrator 15*b* and guide assembly 16 to be centered.

The above-described type of connection assures that transverse stresses occurring during the penetrating action of projectile 15 cannot have any effect in the conical region 15*a* of penetrator 15*b*. Thus, at most the externally threaded pin 15*c* of penetrator 15*b* will be sheared off, so that a considerable portion of penetrator 15*b* coaxially surrounded by guide assembly 16 is able to participate in the penetration of the target.

In a preferred embodiment of the invention, the conical region 15*a* of penetrator 15*b* had a length of about 70 mm; the conical recess 16*a* in guide assembly 16 had a length of about 40 mm. The angle $\alpha$ was 5°, while the angle $\beta$ was 7°.

What is claimed is:

1. A fin-stabilized subcaliber projectile, comprising:

an elongated kinetic energy penetrator having a cylindrical surface for most of its length and having a high ratio of length to diameter, the penetrator additionally having a tail end and a rear region with a conically configured surface adjacent the tail end, the conically configured surface having a cone angle $\alpha$, the penetrator additionally having a cylindrical pin with an external thread at the tail end; and a rear guide assembly having a recess with a conically configured surface, the conically configured surface of the recess having a cone angle $\beta$ which is larger than $\alpha$, the guide assembly additionally having an internally threaded bore which communicates with the recess, the pin of the penetrator engaging the bore to breakably attach the guide assembly to the penetrator, wherein the rear region of the penetrator extends into the recess of the guide assembly and the conically configured surfaces are spaced apart.

2. A projectile according to claim 1, wherein the pin terminates in a cone frustum and wherein the bore terminates in a conical blind end, the slope of the cone frustum coinciding with the slope of the blind end.

3. A projectile according to claim 1, wherein the length of the conical recess in the guide assembly is betewen one third and two thirds of the length of the conical region of the penetrator, and wherein the angle $\beta$ is at least two degrees larger than the angle $\alpha$.

4. A projectile according to claim 3, wherein the length of the conical region of the penetrator is about 70 mm, wherein the length of the conical recess in the guide assembly is about 40 mm, wherein the angle $\alpha$ has a value of 5°, and wherein the angle $\beta$ has a value of 7°.

5. A projectile according to claim 1, wherein the penetrator is made from tungsten.

6. A subcaliber projectile, comprising:

an elongated penetrator having a tail end with a threaded pin, the penetrator additionally having a region with a tapered surface adjacent the threaded pin and a fracture zone between the pin and the region with the tapered surface; and a guide assembly which includes a central member and stabilizing fins which extend from the central member, the central member having a recess with a surface and having a threaded bore centrally disposed in the recess, the pin being screwed into the bore and the tapered surface of the penetrator being spaced apart from the surface of the recess in the central member of the guide assembly.

7. A projectile according to claim 6, wherein the tapered surface of the penetrator is conical and wherein the surface of the recess in the central member is conical.

8. A projectile according to claim 7 wherein the penetrator has a penetrator axis, wherein the central member has a central member axis which substantially coincides with the penetrator axis, and wherein the angle between the penetrator axis and the conical surface of the penetrator is smaller than the angle between the central member axis and the conical surface of the recess in the central member.

9. A projectile according to claim 8 wherein the bore terminates in a conical region having a slope, and wherein the pin terminates in a frustoconical portion having a slope which coincides with the slope of the conical region of the bore, so that the frustoconical portion of the pin contacts the conical region of the bore.

10. A projectile according to claim 6, wherein the bore terminates in a conical region having a slope, and wherein the pin terminates in a frustoconical portion having a slope which coincides with the slope of the conical region of the bore, so that the frustoconical portion of the pin contacts the conical region of the bore.

11. A projectile according to claim 6, wherein the penetrator is made from tungsten.

* * * * *